US006938627B2

(12) United States Patent
Jung et al.

(10) Patent No.: US 6,938,627 B2
(45) Date of Patent: Sep. 6, 2005

(54) DISHWASHER

(75) Inventors: Tae-Young Jung, Suwon (KR); Sam-Yong Jang, Yongin (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/322,602

(22) Filed: Dec. 19, 2002

(65) Prior Publication Data

US 2004/0007253 A1 Jan. 15, 2004

(30) Foreign Application Priority Data

Jul. 9, 2002 (KR) ..... 2002-39695

(51) Int. Cl.[7] ..... B08B 13/00

(52) U.S. Cl. ..... 134/104.2; 134/104.4; 134/111; 68/18 F

(58) Field of Search ..... 134/57 D, 56 D, 134/58 D, 104.1, 104.2, 104.4, 111; 68/3 R, 18 F, 208

(56) References Cited

U.S. PATENT DOCUMENTS

| | | | | | |
|---|---|---|---|---|---|
| 1,638,549 | A | * | 8/1927 | Ohmart | 134/111 |
| 1,672,286 | A | * | 6/1928 | Stringham et al. | 134/25.2 |
| 1,927,665 | A | * | 9/1933 | Kirby | 134/111 |
| 2,023,013 | A | * | 12/1935 | Faber et al. | 8/159 |
| 2,103,966 | A | * | 12/1937 | Behan | 68/18 F |
| 2,199,792 | A | * | 5/1940 | Haberstump | 68/208 |
| 2,201,790 | A | * | 5/1940 | Rouch | 68/208 |
| 2,343,743 | A | * | 3/1944 | Breckenridge | 68/208 |
| 2,353,993 | A | * | 7/1944 | Cavicchioli | 4/629 |
| 2,360,278 | A | * | 10/1944 | Robertson | 68/18 F |
| 2,413,954 | A | * | 1/1947 | Conterman | 210/451 |
| 2,562,076 | A | * | 7/1951 | Weisselberg | 134/139 |
| 2,564,443 | A | * | 8/1951 | Palotsee | 68/15 |
| 2,575,542 | A | * | 11/1951 | Wubbe | 210/454 |
| 2,586,398 | A | * | 2/1952 | Vars | 134/58 D |
| 2,586,508 | A | * | 2/1952 | Brotman | 210/437 |
| 2,592,597 | A | * | 4/1952 | Pengelly | 68/23.5 |
| 2,627,863 | A | * | 2/1953 | Cavicchioli | 134/104.3 |
| 2,651,190 | A | * | 9/1953 | Horvath | 68/12.14 |
| 2,938,366 | A | * | 5/1960 | Maddock-Clegg | 68/17 R |
| 2,969,665 | A | * | 1/1961 | Saverio | 68/184 |
| 3,385,085 | A | * | 5/1968 | Engel | 68/18 F |
| 3,402,576 | A | * | 9/1968 | Krupsky | 68/4 |

(Continued)

FOREIGN PATENT DOCUMENTS

| | | | |
|---|---|---|---|
| DE | 2827254 | * | 1/1980 |
| FR | 2408336 | * | 10/1977 |
| GB | 2190926 | * | 12/1987 |
| JP | 7284468 | | 10/1995 |
| JP | 9-66017 | * | 3/1997 |
| JP | 2000-14620 | * | 1/2000 |

OTHER PUBLICATIONS

European Patent Office 597,508 May 1994.*
European Patent Office 597,513 May 1994.*
European Patent Office 1,201,812 May 2002.*
English Translation of Abstract of JP4109924 with FIGS. 1–4.

*Primary Examiner*—Frankie L. Stinson
(74) *Attorney, Agent, or Firm*—Staas & Halsey LLP

(57) ABSTRACT

A dishwasher is provided such that an impurity-collecting filter collecting impurities is detachably mounted to a front of a cabinet, thus allowing the impurity-collecting filter to be easily cleaned, and keeping a bottom of a washing tub cleaner. The dishwasher includes a cabinet, the washing tub provided in the cabinet, a water container installed under the washing tub collecting wash water, and the impurity-collecting filter provided in the water container collecting the impurities contained in the wash water. The impurity-collecting filter is removably mounted in the water container through an external surface of the cabinet at a position around the water container.

28 Claims, 5 Drawing Sheets

U.S. PATENT DOCUMENTS 3,533,841 A * 10/1970 Radach ..... 134/111
3,949,772 A * 4/1976 Hartmann ..... 134/99.1
4,268,396 A * 5/1981 Lowe ..... 210/670
4,566,970 A * 1/1986 Piai et al. ..... 210/409
4,580,421 A * 4/1986 Babuin et al. ..... 68/12.13
5,660,063 A * 8/1997 Lee et al. ..... 68/18 F

* cited by examiner

DISHWASHER

CROSS-REFERENCE TO RELATED APPLICATION

This application claims the benefit of Korean Application No. 2002-39695, filed Jul. 9, 2002, in the Korean Intellectual Property Office, the disclosure of which is incorporated herein by reference.

BACKGROUND OF THE INVENTION

1. Field of the Invention

The present invention relates generally to a dishwasher, and more particularly, to a dishwasher which is designed such that an impurity-collecting filter to collect impurities is detachably mounted to a front of a cabinet, thus allowing the impurity collecting filter to be easily cleaned, and keeping a bottom of a washing tub cleaner.

2. Description of the Related Art

As is well known to those skilled in the art, a dishwasher includes a cabinet 1 and a door 3, as shown in FIG. 1. A washing tub 2 is defined in the cabinet 1. The door 3 is hinged, at a lower end thereof, to a front of the cabinet 1 so as to selectively close an opening formed on a front of the washing tub 2. Baskets 2*a* are interiorly installed at upper and lower positions of the washing tub 2, respectively, so as to slide in and slide out of the cabinet 1, and to hold dishes in the baskets 2*a*. An injection nozzle 2*c* is mounted to a lower portion of each of the baskets 2*a* so as to spray wash water on the dishes held in the basket 2*a* and the injection nozzle 2*c* is connected to a water supply pipe 2*b*. A water container 4 is installed between a bottom of the washing tub 2 and a bottom of the cabinet 1 so as to collect the sprayed wash water. A circulation pump 6 is mounted at a predetermined position on the water container 4. A drain pump 5 is set at a lower position than the water container 4. A drain pipe 5*a* connects the water container 4 to the drain pump 5, and a circulation pipe 6*a* connects the water container 4 to the circulation pump 6. The circulation pipe 6*a* communicates with the water supply pipe 2*b* which is connected to the injection nozzle 2*c*.

Such a construction allows the wash water to circulate in the dishwasher. The wash water sprayed from the injection nozzle 2*c* passes through the water container 4, the circulation pipe 6*a* and the water supply pipe 2*b*, and returns to the injection nozzle 2*c*. When a predetermined time has elapsed, the wash water is discharged to an outside by an operation of the drain pump 5.

While the wash water circulates in the dishwasher according to the above circulating cycle, impurities, such as food residues which have been removed from the dishes, exist in the wash water. Thus, a filtering unit is provided in the water container 4 so as to remove the impurities from the wash water while filtering the wash water circulating in the dishwasher.

The filtering unit comprises a circulation filter 8, and an impurity-collecting filter 9. The circulation filter 8 is installed on a central portion of the bottom of the washing tub 2, and covers a top of the water container 4. Further, the impurity-collecting filter 9 is inserted into an insertion hole 8*a* to be mounted in the water container 4. The insertion hole 8*a* is formed on a central portion of the circulation filter 8.

The circulation filter 8 has a plate shape which is downwardly inclined toward the insertion hole 8*a* so as to guide the impurities into the impurity-collecting filter 9. Perforations are formed throughout the circulation filter 8, so that the impurities remain in the circulation filter 8 while the wash water passes through the perforations. The impurities remaining in the circulation filter 8 are guided to the insertion hole 8*a* by the inclined shape of the circulation filter 8, and then are collected in the impurity-collecting filter 9.

Further, the impurity-collecting filter 9 has a cylinder shape, and is provided on a sidewall thereof with filtering perforations, so that the impurities remain in the impurity-collecting filter 9 while the wash water passes through the filtering perforations, thus collecting the filtered impurities in the impurity-collecting filter 9.

The impurities are filtered from the wash water while the wash water passes through the perforations of the circulation filter 8 and the filtering perforations of the collection filter 9, and then are collected in the impurity-collecting filter 9. The wash water collected in the water container 4 sequentially passes through the circulation pipe 6*a*, the water supply pipe 2*b*, and the injection nozzle 2*c*, and then is injected again into the wash tub 2.

However, the conventional dishwasher is problematic in that some of the impurities may accumulate at an upper surface of the circulation filter 8 without moving into the impurity-collecting filter 9 along the upper surface of the circulation filter 8.

Further, both the circulation filter 8 and the impurity-collecting filter 9 are installed at the bottom of the washing tub 2 such that the circulation filter 8 and the impurity-collecting filter 9 are exposed to an interior of the washing tub 2. Thus, when a user opens the door 3 after finishing washing the dishes, the impurities which have accumulated at the upper surface of the circulation filter 8 or have collected in the impurity-collecting filter 9 are viewed by a user, thus creating an unpleasant experience for the user.

When the impurities collected in the impurity-collecting filter 9 exceed a predetermined amount, the user must remove the impurity-collecting filter 9 from the cabinet 1 so as to clean the impurity-collecting filter 9. However, removing the impurity-collecting filter 9 from the cabinet 1 is difficult. That is, in order to remove the impurity-collecting filter 9 from the cabinet 1, the user first opens the door 3, pulls the basket 2*a* toward the door 3, and then removes the impurity-collecting filter 9 from the insertion hole 8*a* of the circulation filter 8. However, when the user removes the impurity-collecting filter 9 from the cabinet 1, dirty water held in the impurities, such as food residues, collected in the impurity-collecting filter 9 may exit the impurity-collecting filter 9 and contaminate an interior space of the washing tub 2.

SUMMARY OF THE INVENTION

Accordingly, a dishwasher which is designed such that an impurity-collecting filter to collect impurities is detachably mounted to a front of a cabinet, thus allowing the impurity-collecting filter to be easily cleaned, and keeping a bottom of a washing tub cleaner is provided.

Additional aspects and advantages of the invention will be set forth in part in the description which follows and, in part, will be obvious from the description, or may be learned by practice of the invention.

In order to accomplish the above and other aspects, a dishwasher comprising a cabinet, a washing tub provided in the cabinet, a water container installed under the washing tub to collect wash water, and an impurity-collecting filter provided in the water container collecting impurities contained in the wash water, wherein the impurity-collecting filter is removably mounted in the water container through an external surface of the cabinet at a position around the water container.

The dishwasher further comprises an opening formed on a front surface of the cabinet so that the impurity-collecting filter is installed through the external surface of the cabinet, an extension part provided at the water container and extending to the opening so as to receive the impurity-collecting filter, and a guide member connecting the washing tub to the impurity-collecting filter, such that the guide member allows the wash water from the washing tub to join the wash water in the water container while guiding the impurities contained in the wash water to the impurity-collecting filter.

Further, the impurity-collecting filter comprises a stopper removably installed in an end of the impurity-collecting filter closing the opening at a first end thereof and closing the extension part around the opening at a second end thereof, and a filtering unit removably assembled at a first end thereof with the stopper, and assembled with the guide member at a second end thereof.

A plurality of perforations may be formed over an entire surface of the guide member.

The filtering unit has a multi-filter structure comprising an inner filtering part provided at an inner position of the filtering unit to catch large impurities, and at least one outer filtering part provided outside of the inner filtering part to catch impurities having a size smaller than the impurities caught by the inner filtering part, whereby the inner filtering part and the outer filtering part, respectively, have cylindrical net structures separable from each other.

A sealing member may be provided between the stopper and the extension part so as to prevent the wash water from the water container from leaking out of the extension part.

The stopper engages with the extension part in a screw-type fastening method.

Further, a circulation pump and a drain pump are connected to predetermined positions of the water container by pipes, respectively, and the circulation pump is used to circulate the wash water from the water container into the washing tub, and the drain pump is used to discharge the wash water from the water container to an outside.

BRIEF DESCRIPTION OF THE DRAWINGS

These and other aspects and advantages of the invention will become apparent and more readily appreciated from the following description of the preferred embodiments, taken in conjunction with the accompanying drawings of which.

DESCRIPTION OF THE PREFERRED EMBODIMENT

Figure 1:
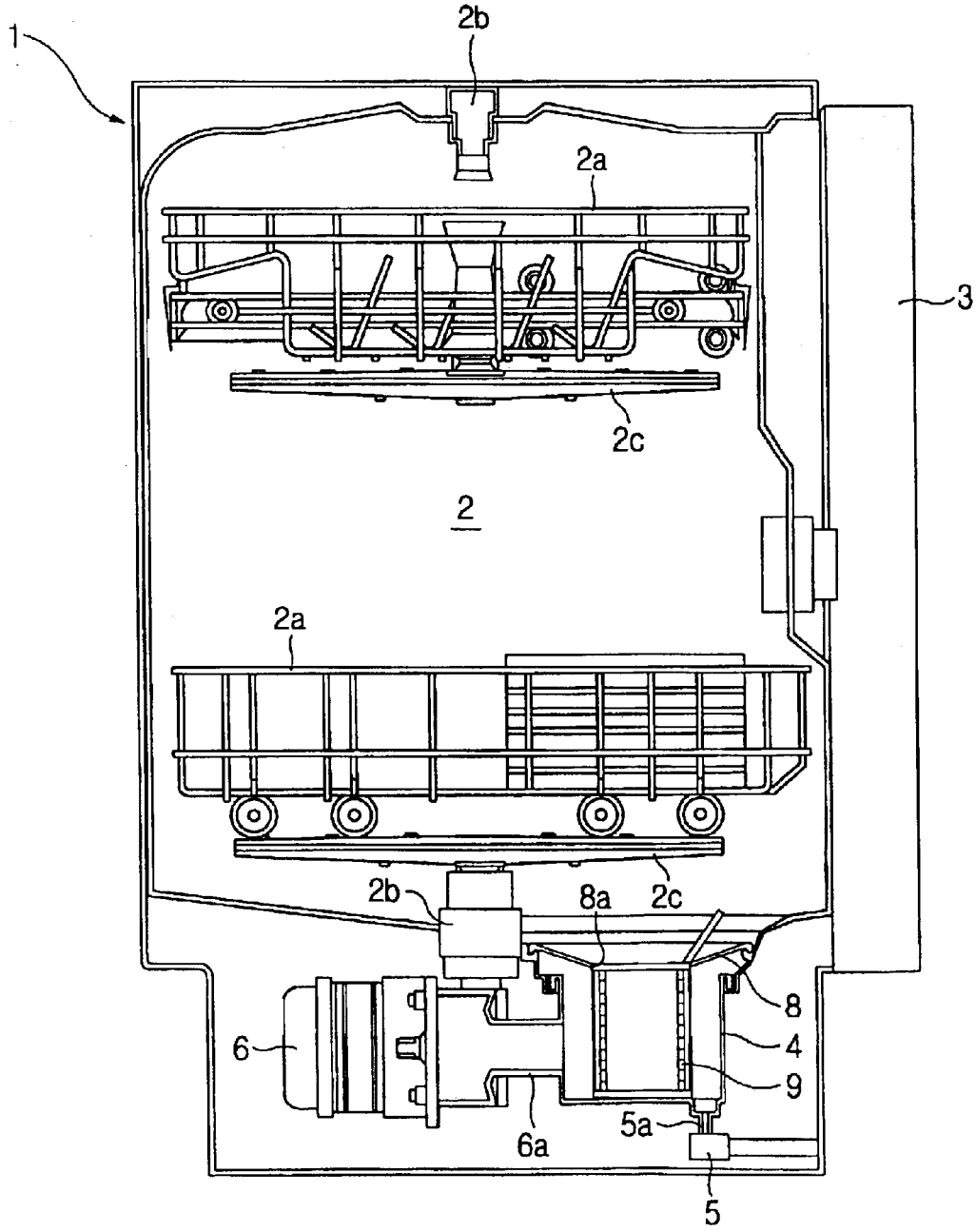
FIG. 1 (PRIOR ART)
FIG. 1 is a sectional view showing a construction of a conventional dishwasher.
Figure 2:
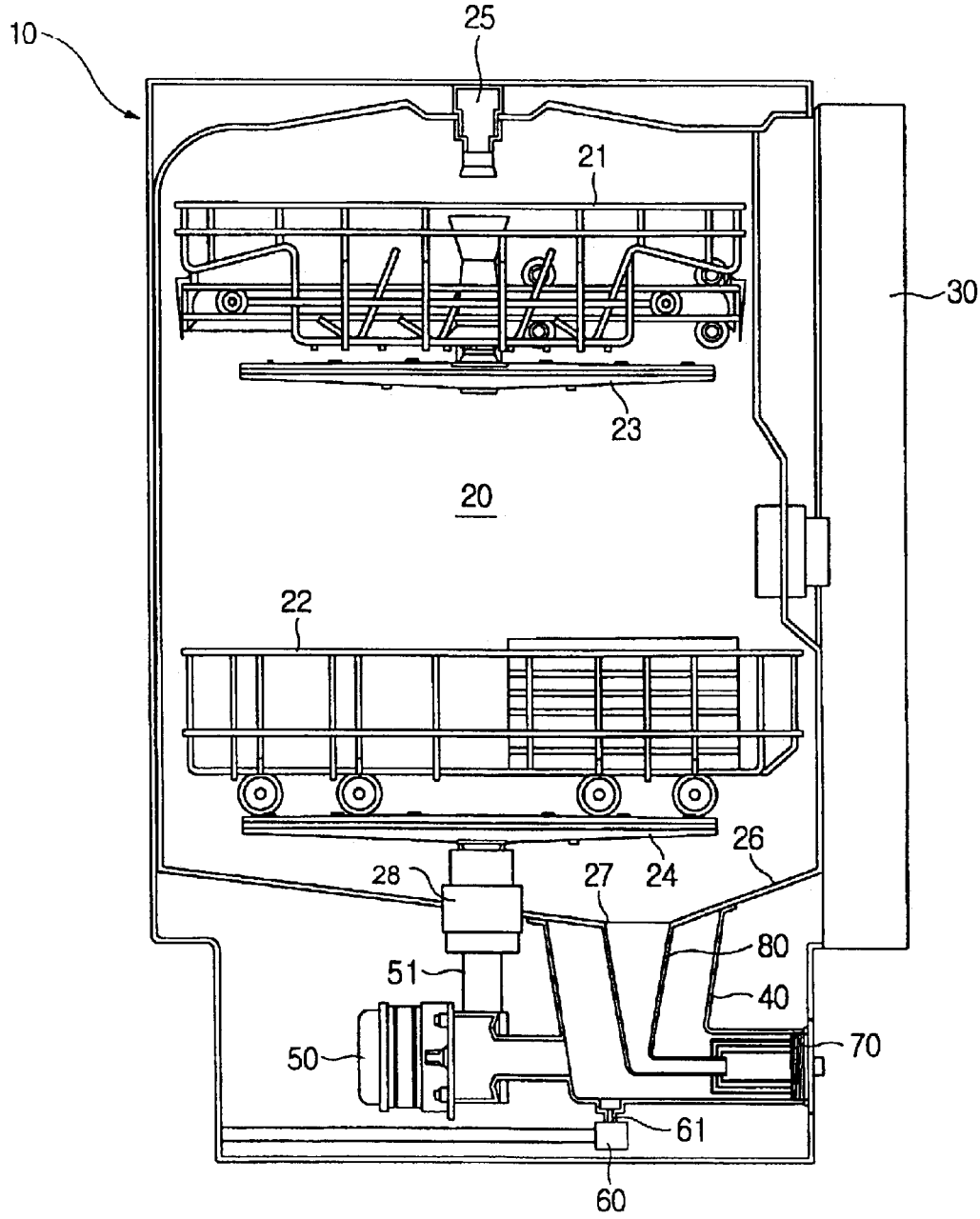
FIG. 2 is a sectional view showing a construction of a dishwasher according to an embodiment of the present invention.

These and other aspects and advantages of the invention will become apparent and more readily appreciated from the following description of the preferred embodiments, taken in conjunction with the accompanying drawings of which:

As shown in FIG. 2, the dishwasher comprises a cabinet 10. A door 30 is hinged to a lower portion on a front of the cabinet 10. A washing tub 20 is provided in the cabinet 10, and defines a space receiving dishes to be washed. The door 30 allows selective opening of the washing tub 20.

Two baskets 21 and 22 receiving dishes are slidably provided in the washing tub 20, thus allowing a user to slide each of the two baskets 21 and 22 out of the washing tub 20 as necessary. An upper basket 21 is installed at an upper position in the washing tub 20, and a lower basket 22 is installed at a lower position in the washing tub 20. Upper and lower injection nozzles 23 and 24 are installed under the upper and lower baskets 21 and 22, respectively, and spray wash water on dishes contained in the upper and lower baskets 23 and 24. The upper injection nozzle 23 is connected to a first water supply pipe 25 which is installed at an upper portion of the washing tub 20, and the lower injection nozzle 24 is connected to a second water supply pipe 28 which is installed at a lower portion of washing tub 20.

A water container 40 is installed in the cabinet 10 and under the washing tub 20 to collect the wash water. The washing tub 20 is provided on a bottom surface 26 thereof with an inlet hole 27. The wash water from the washing tub 20 flows into the water container 40 through the inlet hole 27. The bottom surface 26 of the washing tub 20 is downwardly inclined to the inlet hole 27 so as to more easily guide the wash water into the inlet hole 27. An upper end of the water container 40 is mounted to the bottom surface 26 of the washing tub 20 around the inlet hole 27, so that the water container 40 is installed under the washing tub 20. A circulation pump 50 is installed at a predetermined position in a vicinity of the water container 40 to circulate the wash water in the dishwasher, and a drain pump 60 is installed at a lower position of the water container 40 to discharge the wash water from the water container 40 to an outside. A circulating pipe 51 connects the circulation pump 50 to the water container 40, whereas a drain pipe 61 connects the drain pump 60 to the water container 40. In this case, the circulation pipe 51 serves to supply the wash water to the first and second water supply pipes 25 and 28 which are connected to the upper and lower injection nozzles 23 and 24, respectively.

The circulation of the wash water in the dishwasher occurs as follows. When the wash water is sprayed from the upper and lower injection nozzles 23 and 24, respectively, the wash water sequentially passes through the water container 40 and the water circulation pipe 51 and then flows into the first and second water supply pipes 25 and 28, by the operation of the circulation pump 50. The wash water flowing into the first and second water supply pipes 25 and 28 is again supplied to the upper and lower injection nozzles 23 and 24, respectively, and is repeatedly circulated in the dishwasher. After a predetermined period of time has elapsed, the wash water is discharged to the outside of the dishwasher through a drain pipe 61 by an operation of the drain pump 60.

While the wash water circulates in the dishwasher according to the above circulation cycle, impurities, such as food residues, removed from dishes, exist in the wash water. Thus, a filtering unit must be provided in the water container 40 so as to remove the impurities from the wash water while the wash water circulates in the dishwasher.

The filtering unit comprises an impurity-collecting filter 70 and a guide member 80. The impurity-collecting filter 70 collects impurities contained in the wash water which circulates in the dishwasher. The guide member 80 connects the washing tub 20 to the impurity-collecting filter 70 such that the guide member 80 allows the wash water from the washing tub 20 to flow into the water container 40 while guiding the impurities contained in the wash water to the impurity-collecting filter 70. The guide member 80 is set in the water container 40 such that an upper end of the guide member 80 communicates with the inlet hole 27.

The impurity-collecting filter 70 is removably mounted in the water container 40 through a front surface of the cabinet 10 at a position around the water container 40, so as to allow easy cleaning of the impurity-collecting filter 70 and maintaining of the clean bottom surface 26 of the washing tub 20. The construction to achieve the above feature will be described in detail in the following.

Figure 3:
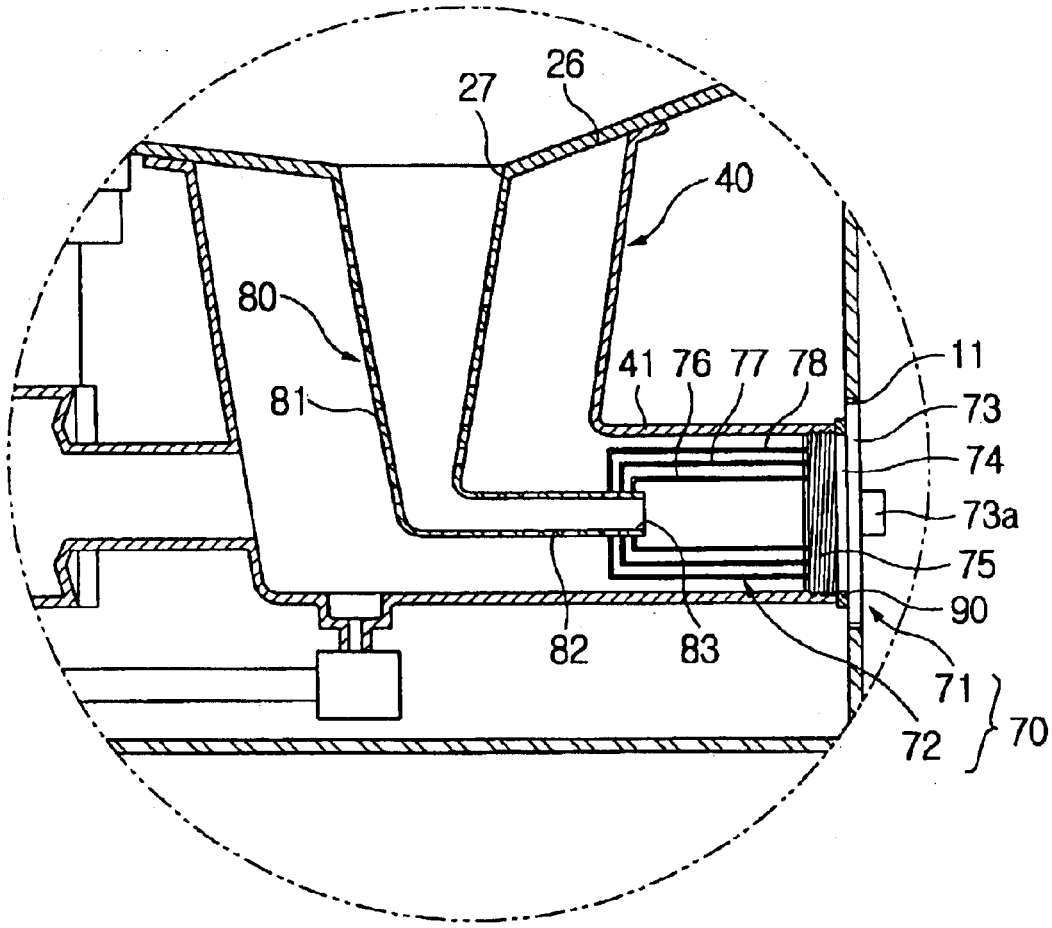
FIG. 3 is a partial sectional view showing a filtering unit of FIG. 2.

As shown in FIG. 3, the dishwasher has an opening 11, which has a predetermined size and is formed on the front surface of the cabinet 10 below the door 30. The opening 11 allows the impurity-collecting filter 70 to be directly mounted in the water container 40 through the front surface of the cabinet 10 below the door 30. Further, an extension part 41 is provided at a lower position of the water container 40, so the impurity-collecting filter 70 is received in the water container 40 along the extension part 41. The extension part 41 is bent so as to extend from the lower position of the water container 40 to the opening 11 which is formed on the front surface of the cabinet 10.

The guide member 80 allows the wash water from the washing tub 20 to join the wash water in the water container 40, so the wash water from the washing tub 20 flows into the water container 40. The guide member 80 serves to guide the impurities contained in the wash water into the impurity-collecting filter 70. A plurality of perforations 81 are formed throughout a surface of the guide member 80, so that the wash water passes through the perforations 81 while the impurities are caught in the guide member 80. The guide member 80 is provided on the bottom surface 26 of the washing tub 20 around the inlet hole 27, and is downwardly tapered. A bent part 82 is provided at a lower end of the guide member 80 and extends in a common direction as a direction of extension of the extension part 41. An insertion part 83 is provided at an end of the bent part 82 so as to be inserted into a filtering unit 72 of the impurity-collecting filter 70 to a predetermined length, and guides the impurities into the impurity-collecting filter 70.

The impurity-collecting filter 70 comprises a stopper 71 and the filtering unit 72. The stopper 71 closes the opening 11 which is formed on the front surface of the cabinet 10 and closes the extension part 41 of the water container 40, at the same time. The filtering unit 72 is installed in the extension part 41 within an area defined by the extension part 41 so as to filter the impurities guided by the guide member 80. The filtering unit 72 is removably assembled, at a first end thereof, with the stopper 71, and is assembled, at a second end thereof, with the guide member 80.

Further, the stopper 71 has a single structure comprising an outer part 73, an intermediate part 74 and an inner part 75. The outer part 73 is provided at an outer portion of the stopper 71 closing the opening 11. The inner part 75 is provided at an inner portion of the stopper 71 and engages with the extension part 41 around the opening 11 in a screw-type fastening operation. The intermediate part 74 is provided between the outer and inner parts 73 and 75. An external thread is formed on an outer surface of the inner part 75, and an internal thread is formed on an inner surface of the extension part 41 which engages with the externally threaded inner part 75, thereby engaging the stopper 71 with the extension part 41 around the opening 11 in a screw-type fastening operation.

A handle 73*a* is provided on an external surface of the outer part 73 and is used to allow a user to rotate the stopper 71. When the inner part 75 engages with or disengages from the extension part 41 around the opening 11 according to the rotation of the handle 73*a,* the impurity-collecting filter 70 is assembled with or removed from the extension part 41. A ring-shaped sealing member 90 is provided on an outer surface of an intermediate part 74, and seals a gap between an inner surface of the outer part 73 of the stopper 71 and an end of the extension part 41 so as to prevent the wash water from the water container 40 from leaking out of the cabinet 10 through the gap between the extension part 41 and the stopper 71.

Figure 4:
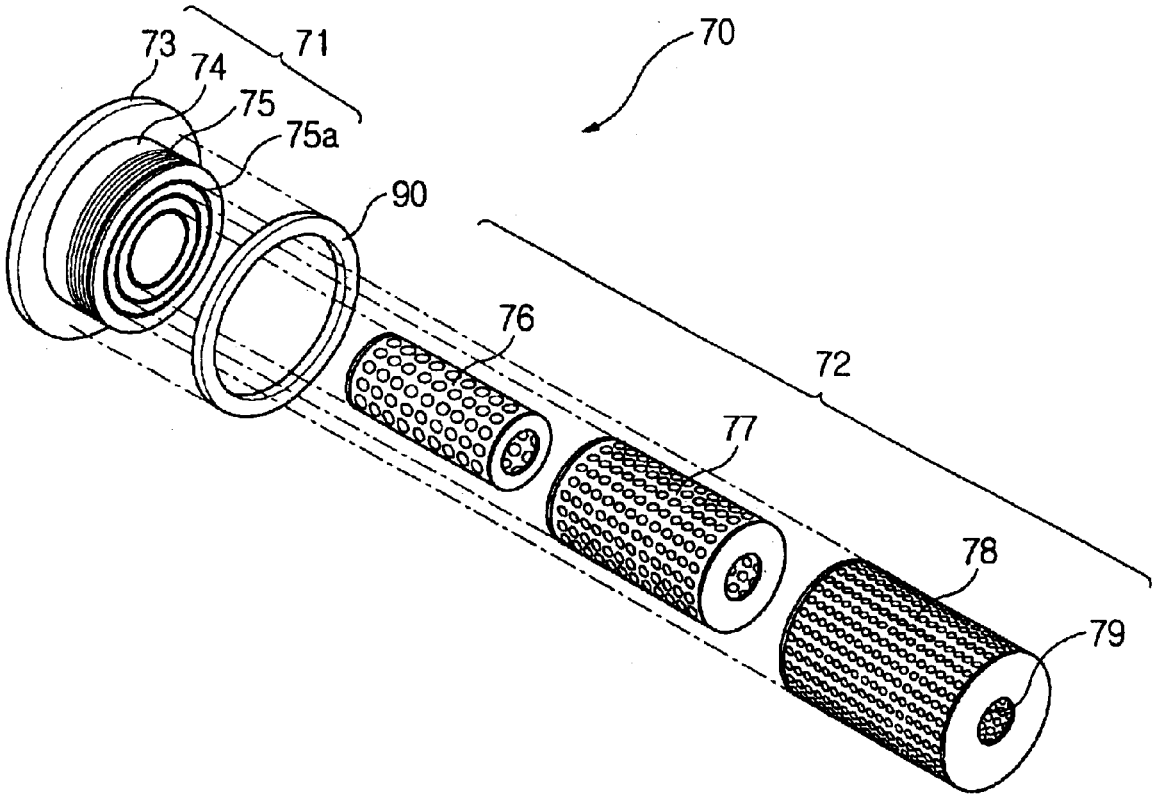
FIG. 4 is an exploded perspective view of an impurity-collecting filter of FIG. 2.

As shown in FIG. 4, the filtering unit 72 is detachably assembled with the stopper 71 and comprises three filtering parts 76–78. The three filtering parts 76–78 of the filtering unit 72 each has a cylindrical shape which is open at one end, and is made of a net to allow the wash water to circulate therethrough. That is, the filtering unit 72 has a multi-filter structure which is capable of selectively and sequentially collecting the impurities according to a mesh of the three filtering parts 76–78. The filtering unit 72 comprises nets having different mesh sizes. The inner filtering part 76 is provided at an inner position of the filtering unit 72 to filter large impurities. A first outer filtering part 77 concentrically surrounds the inner filtering part 76 filtering the impurities which are smaller than the impurities filtered by the inner filtering part 76. A second outer filtering part 78 is provided outside of the first outer filtering part 77, and finally filters fine impurities which pass the first outer filtering part 77.

The three filtering parts 76, 77 and 78 of the filtering unit 72 are removably assembled with the stopper 71 and are easily separated from each other, thus allowing a user to easily clean the filtering unit 72. The stopper 71 has, at an inner position thereof, ring-shaped triple locking grooves 75*a*. Ends of the filtering parts 76, 77 and 78 are inserted into or removed from associated ring-shaped triple locking grooves 75*a,* so that the filtering parts 76, 77 and 78 are removably assembled with the stopper 71.

The filtering unit 72 of the impurity-collecting filter 70 is removably assembled, at a first end thereof, with the stopper 71, and is removably assembled, at a second end thereof, which is opposite to the first end, with the guide member 80. At this time, the insertion part 83 of the guide member 80 is inserted into the filtering unit 72 to a predetermined length. In order to receive the insertion part 83, the three filtering parts 76, 77 and 78 of the filtering unit 72 are provided, at respective ends thereof, which are not assembled with the stopper 71, with insertion holes 79. The insertion holes 79 have a common cross-section as that of the insertion part 83 and are sequentially arranged, as shown in FIG. 3, when the three filtering parts 76, 77 and 78 are assembled to produce the filtering unit 72. The outer surface of the insertion part 83 may be in close contact with the insertion holes 79 so as to prevent the impurities caught by the filtering unit 72 from unexpectedly leaking through a gap between the filtering unit 72 and the guide member 80. The filtering unit 72 may have a simple cylindrical shape or the filter unit 72 may be slightly bent so as to prevent the impurities caught by the filtering unit 72 from undesirably reentering the guide member 80 during the circulation of the wash water.

The dishwasher allows the wash water to circulate from the water container 40 to the washing tub 20, via the guide member 80 and the impurity-collecting filter 70, by an operation of the circulation pump 50. Further, the dishwasher allows the impurities existing in the wash water to be easily filtered by the impurity-collecting filter 70.

The impurity-collecting filter 70 is removably mounted in the water container 40 through the front surface of the cabinet 10, allowing easy cleaning of the filter 70 and maintaining the bottom surface 26 of the washing tub 20 in a clean state. The operation and effect of the invention will be described by the following which describes a process of assembling and disassembling the impurity-collecting filter 70.

Figure 5:
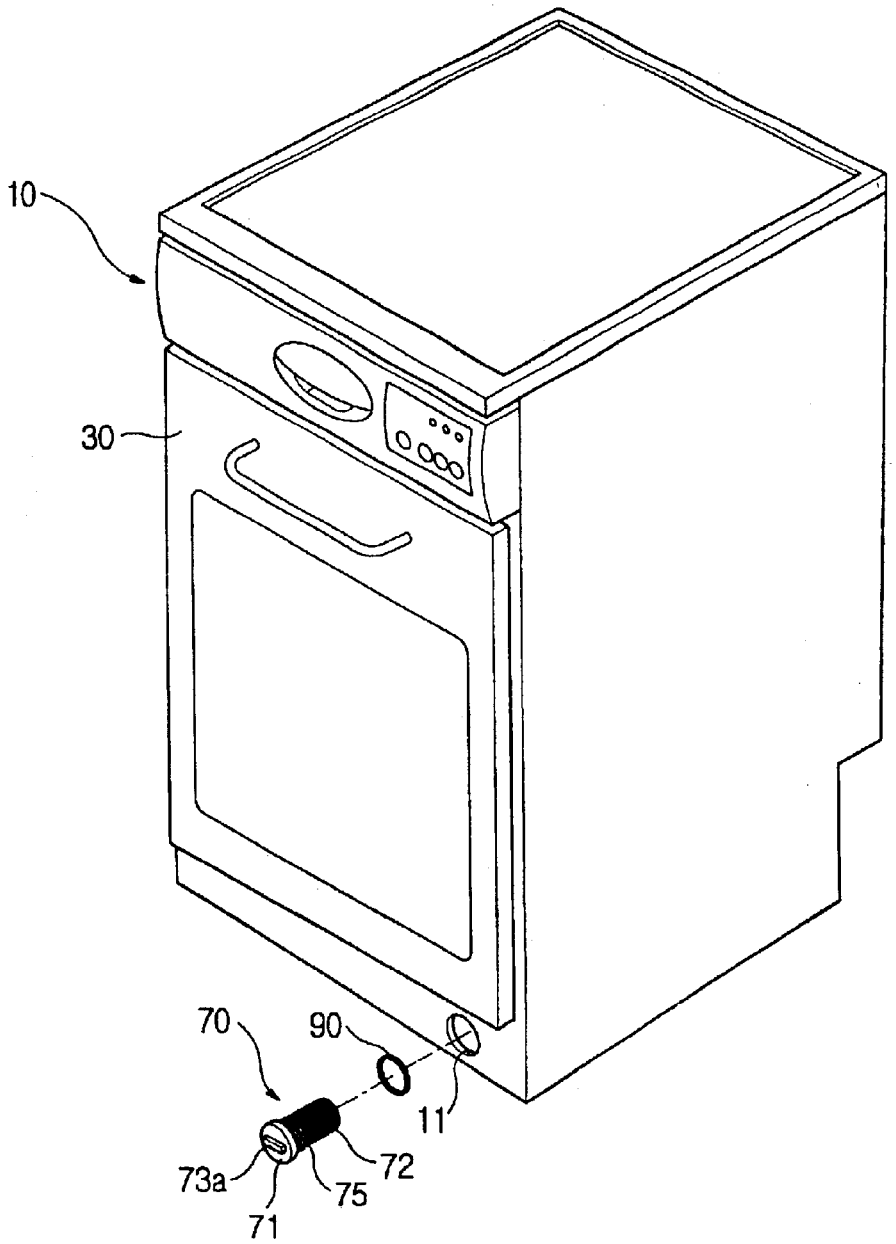
FIG. 5 is a perspective view showing the construction of the dishwasher of FIG. 2.

When the impurities caught in the filtering unit 72 of the impurity-collecting filter 70 exceed a predetermined amount, a user first confirms that the operation of draining the wash water is finished. Next, the user rotates the handle 73*a* of the stopper 71, which is provided at the front surface of the cabinet 10, so as to disengage the inner part 75 of the stopper 71 from the extension part 41. After that, as shown in FIG. 5, the stopper 71 with the impurity-collecting filter 70 is removed from the cabinet 10 through the opening 11 which is formed on the front surface of the cabinet 10. Thereafter, the second outer filtering part 78, the first outer filtering part 77 and the inner filtering part 76 are sequentially removed from the locking grooves 75*a* which are formed on the inner part 75 of the stopper 71, and are then, respectively, cleaned.

When cleaning of the three filtering parts 76, 77 and 78 is completed, ends of the filtering parts 76, 77 and 78 are inserted again into the locking grooves 75*a* which are formed on the inner part 75 of the stopper 71, to assemble the three filtering parts 76, 77 and 78 with the stopper 71. Thereafter, the stopper 71 with the filtering unit 72 is tightened to the opening 11 of the cabinet 10 such that the insertion part 83 of the guide member 80 is inserted into the filtering unit 72 of the impurity-collecting filter 70. Therefore, the filtering unit 72 is set in the extension part 41 of the water container 40. At this time, the user rotates the handle 73*a* of the stopper 71 in a reverse direction so that the extension part 41 engages with the inner part of the stopper 71 in a screw-type fastening operation method. Thus, the process of assembling the impurity-collecting filter 70 is completed.

Accordingly, the impurity-collecting filter 70 is not exposed to an interior of the washing tub 20, so the impurities deposited in the filter 70 are not exposed to the user when the door 30 is opened after finishing washing the dishes, thus the bottom surface 26 of the washing tub 20 appears cleaner. Further, the impurity-collecting filter 70 is removably mounted in the cabinet 10 through the front surface of the cabinet 10 below the door 30, so the impurity-collecting filter 70 is removed from the cabinet 10 without opening the door 30 or moving either of the upper or lower baskets 21 or 22, thus making cleaning easier. When the impurity-collecting filter 70 is removed from the dishwasher, the dirty water from the impurities collected in the impurity-collecting filter 70 does not exit the impurity-collecting filter 70, thus keeping the bottom surface 26 of the washing tub 20 cleaner.

The impurity-collecting filter 70 is provided in the water container 40 through the external surface of the cabinet 10 below the door 30, but a mounting position of the impurity-collecting filter 70 may be changed to another appropriate position according to a construction of a sink or a kitchen where the dishwasher is installed. The extension part 41 to seat the impurity-collecting filter 70 may be provided on a side surface or a rear surface of the cabinet 10, and the opening 11 to install the impurity collecting filter 70 may be formed on the side surface or the rear surface of the cabinet 10 corresponding to a position of the extension part 41.

Although a preferred embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A dishwasher, comprising:

a washing tub provided in a cabinet of the dishwasher, to wash dishes;

a water container installed under the washing tub, to collect wash water; and an impurity-collecting filter provided in the water container, to collect impurities contained in the wash water, said impurity-collecting filter being removably mounted in the water container through an external surface of the dishwasher; and a guide member to connect the washing tub to the impurity-collecting filter so that the guide member allows the wash water from the washing tub to join the wash water in the water container while guide the impurities contained in the wash water to the impurity-collecting filter, wherein said impurity-collecting filter includes:

a stopper removably installed in an end of the impurity-collecting filter to close said opening at a first end thereof and to close said extension part around the opening at a second end thereof; and a filtering unit removably assembled at a first end thereof with said stopper, and assembled with said guide member at a second end thereof.

2. The dishwasher according to claim 1, further comprising:

an opening formed on a front surface of the cabinet so that the impurity-collecting filter is installed through the external surface of the cabinet;

an extension part provided at the water container and extending to the opening so as to receive the impurity-collecting filter; and a guide member connecting the washing tub to the impurity-collecting filter such that the guide member allows the wash water from the washing tub to join the wash water in the water container while guiding the impurities contained in the wash water to the impurity-collecting filter.

3. The dishwasher according to claim 2, wherein the guide member comprises:

a plurality of perforations formed over an entire surface thereof.

4. The dishwasher according to claim 2, wherein said filtering unit has a multi-filter structure comprising:

an inner filtering part provided at an inner position of the filtering unit catching large impurities; and at least one outer filtering part provided outside of the inner filtering part catching impurities having a size smaller than the impurities caught by the inner filtering part, wherein said inner and outer filtering parts have cylindrical net structures separable from each other.

5. The dishwasher according to claim 2, further comprising:

a sealing member provided between the stopper and the extension part so as to prevent the wash water from the water container from leaking out of the extension part.

6. The dishwasher according to claim 2, wherein said stopper engages with the extension part in a screw-type manner.

7. The dishwasher according to claim 2, further comprising:

a circulation pump and a drain pump connected to predetermined positions of the water container by respective pipes said circulation pump circulating the wash water from the water container into the washing tub, and said drain pump discharging the wash water from the water container to an outside.

8. A dishwasher having a cabinet, comprising:

a water container having an impurity-collecting filter removably mounted in the water container through an external surface of the dishwasher and accessible from outside of the cabinet to collect impurities in wash water; and a guide member provided between a washing tub disposed in the cabinet and the impurity-collecting filter, to guide the impurities in the wash water to the impurity-collecting filter, the guide member including a plurality of perforations formed over an entire surface thereof.

9. The dishwasher according to claim 8, wherein the cabinet comprises:

an access opening at a front of the cabinet; and the impurity-collecting filter is installable and removable from the dishwasher by the access opening from the outside of the cabinet.

10. The dishwasher according to claim 9, further comprising:

a water container to collect wash water; and an extension part provided between the water container and the access opening to receive the impurity-collecting filter.

11. The dishwasher according to claim 10, wherein the extension part is bent so as to extend from a lower position of the water container to the access opening formed on a front of the cabinet.

12. The dishwasher according to claim 10, wherein the impurity-collecting filter comprises:

a stopper adjacent to one end of the impurity-collecting filter and removably closing the access opening and removably closing the extension part in a vicinity of the access opening therewith; and a filtering unit removably provided between the stopper and the guide member to collect to collect the impurities in the wash water.

13. The dishwasher according to claim 12, wherein the filtering unit is bent to prevent impurities from reentering the guide member.

14. The dishwasher according to claim 12, wherein the filtering unit includes plural discrete concentric filters and comprises:

an inner filtering part catching the impurities larger than a first predetermined size; and at least an outer filtering part provided concentrically outside of the inner filtering part, catching the impurities larger than a second predetermined size.

15. The dishwasher according to claim 14, wherein the first predetermined size is different from the second predetermined size.

16. The dishwasher according to claim 14, wherein the filtering unit further comprises:

an intermediate filtering part concentrically between the inner filtering part and the outer filtering part and catching the impurities larger than a third predetermined size.

17. The dishwasher according to claim 16, wherein the first, second and third predetermined sizes are sized so that the third predetermined size is larger than the first predetermined size and smaller than the second predetermined size or the third predetermined size is smaller than the first predetermined size and larger than the second predetermined size.

18. The dishwasher according to claim 14, wherein at least the inner and outer filtering parts are formed as meshed structures.

19. The dishwasher according to claim 12, wherein the filtering unit includes plural adjacent filters to successively filter impurities of smaller sizes.

20. The dishwasher according to claim 12, wherein:

the filtering unit includes plural adjacent filters; and the stopper comprises plural locking grooves on one side thereof corresponding to the plural adjacent filters, each of the plural filters being insertable into or removable from the corresponding locking groove.

21. The dishwasher according to claim 12, further comprising:

a sealing member provided between the stopper and the extension part to prevent leaking of the wash water from the water container.

22. The dishwasher according to claim 12, wherein the stopper screw couples to the extension part.

23. The dishwasher according to claim 12, wherein the stopper has a unitary structure comprising:

an outer part;

an intermediate part;

an inner part, the outer part being provided at an outer portion of the stopper to close the access opening, the inner part being provided at an inner portion of the stopper and screw couples to the extension part in a vicinity of the access opening, and the intermediate part being provided between the outer and inner parts; and a handle being provided on an external surface of the outer part to allow a rotation of the stopper to engage the inner part of the stopper with the extension part or to disengage the inner part of the stopper from the extension part according to a rotation direction of the handle.

24. The dishwasher according to claim 10, further comprising:

plurality of pipes;

a circulation pump; and a drain pump, the circulation and drain pumps each connected to a respective predetermined position of the water container by one or more of the plurality of pipes, the circulation pump circulating the wash water from the water container into the washing tub, and the drain pump discharging the wash water from the water container to an outside.

25. The dishwasher according to claim 10, wherein the washing tub comprises:

a bottom surface downwardly inclined; and an inlet hole provided on the bottom surface of the washing tub to enable the wash water from the washing tub to flow into the water container.

26. The dishwasher according to claim 25, wherein the guide member is set in the water container such that an upper end thereof communicates with the inlet hole.

27. The dishwasher according to claim 10, wherein the extension part to seat the impurity-collecting filter is provided on a side surface or a rear surface of the cabinet, and the access opening to install the impurity collecting filter is formed on the side surface or the rear surface of the cabinet corresponding to a position of the extension part.

28. The dishwasher according to claim 8, further comprising:

a door, wherein the impurity-collecting filter is provided in the water container through an external surface of the cabinet below the door.

* * * * *

UNITED STATES PATENT AND TRADEMARK OFFICE

CERTIFICATE OF CORRECTION

PATENT NO. : 6,938,627 B2
APPLICATION NO. : 10/322602
DATED : September 6, 2005
INVENTOR(S) : Tae-Young Jung et al.

It is certified that error appears in the above-identified patent and that said Letters Patent is hereby corrected as shown below:

Column 9,
Line 52, after "to collect" delete "to collect";

Column 11,
Line 7, replace "impurity collecting" with -- impurity-collecting --.

Signed and Sealed this

Twentieth Day of June, 2006

JON W. DUDAS
*Director of the United States Patent and Trademark Office*